US005228884A

United States Patent [19]

Craven et al.

[11] Patent Number: 5,228,884

[45] Date of Patent: Jul. 20, 1993

[54] METHOD OF OBTAINING A BLOTCH EFFECT ON GARMENTS OR FABRICS

[75] Inventors: Richard Craven, Fort Mill, S.C.; Brian Scism, Charlotte, N.C.; Robert Waddell, Charlotte, N.C.; L. Thomas Holst, Charlotte, N.C.

[73] Assignee: Dexter Chemical Corporation, Bronx, N.Y.

[21] Appl. No.: 528,582

[22] Filed: May 24, 1990

[51] Int. Cl.[5] ..... D06L 3/06

[52] U.S. Cl. ..... 8/108.1; 8/101; 8/107

[58] Field of Search ..... 252/100, 174.23, 95; 8/108.1, 102, 110, 101

[56] References Cited

U.S. PATENT DOCUMENTS 4,917,813 4/1990 Aoyagi et al. ..... 252/95

OTHER PUBLICATIONS

Chemical Abstracts CA 96(4):21227w (1980).

*Primary Examiner*—Prince Willis, Jr.
*Assistant Examiner*—John F. McNally
*Attorney, Agent, or Firm*—Barry Evans

[57] ABSTRACT

A composition useful in obtaining a blotchy bleach effect on garments or fabrics comprising a thickening medium comprising a cellulosic ether, a bleaching agent, and an organic acid.

2 Claims, No Drawings

METHOD OF OBTAINING A BLOTCH EFFECT ON GARMENTS OR FABRICS

BACKGROUND OF THE INVENTION

This invention relates to a method for creating a blotchy bleached effect on fabric and/or garments.

Over the years, in response to changing fashion demands, various methods have been developed for patterning fabrics. An early example of such a method is disclosed in U.S. Pat. No. 1,024,668, which teaches a method for transferring a pattern of a color changing agent from a paper web to a fabric. The pattern may be formed on the paper web by application of discharges, which are agents for removing color from selected areas of a substrate which has been previously colored. The actual transfer of the pattern on the paper web to the fabric is effected in various ways, including employing a roller or the pressure of an engine. Such a method, however, employing large cumbersome machinery, is time consuming, labor intensive and costly.

U.S. Pat. No. 1,905,346 discloses a method of producing color effects on fabric, particularly fabric containing organic derivatives of cellulose, by discharge printing with an oxidizing agent. More specifically, the fabric is treated with a discharge paste including a thickening agent, e.g., cellulose ethers, and an oxidizing agent.

In other prior methods for imprinting textiles, a coloring agent floating upon the surface of a liquid bath is transferred to a fabric or garment so as to create a desired effect. U.S. Pat. No. 1,846,845 discloses a process and apparatus for imparting a variegated design to webs of air-porous material, particularly textile fabrics, wherein a design of color is floated on the surface of a carrier liquid, preferably water, and is taken off the surface by a web of the fabric to be patterned.

It is currently fashionable to create a blotchy bleached look on garments, in particular, denim fabrics. While many methods for bleaching fabrics are known in the art, the art has not heretofore provided a satisfactory, efficient, and inexpensive means for obtaining the blotchy bleached effect that is currently in demand.

OBJECTS OF THE INVENTION

It is thus a primary object of this invention to provide a method for creating a blotchy bleached design on fabrics or garments, particularly denim garments, which provides the desired appearance on the fabric or garment.

It is a further object of the invention to provide an efficient and inexpensive process by which denim garments can be treated with water soluble materials to efficiently blotch-bleach them to provide the desired look.

It is still a further object of the invention to provide a method which can be used in conjunction with conventional washing processes and will not damage or excessively wear fabrics or garments, and will be efficient to use in industrial textile processes.

It is still a further object of this invention to provide compositions which can be used advantageously in the methods of the invention to create the desired blotchy bleached effect.

SUMMARY OF THE INVENTION

Broadly, the invention is in methods for creating blotchy bleached designs on fabrics or garments wherein a fabric or garment is treated with preferred compositions, which are also a part of the invention, in a washing machine. The compositions contain a thickening agent, desirably a cellulosic ether, a bleach, and an organic acid. The bleach is only partially mixed in the thickening composition in order to create an inhomogeneous mixture of the bleach and the thickening composition. The composition and the fabric or garments are then tumbled in a washing machine for a period sufficient to permit the blotchy bleaching action to take effect and thereafter the garments are finished as known in the art, employing neutralization, rinsing, softening, and drying steps.

DETAILED DESCRIPTION OF THE INVENTION

The compositions of the invention contain a thickening medium, a bleaching agent, and an organic acid. The thickening medium, which comprises the bulk of the composition, is desirably a cellulosic ether which may be selected from one or more or mixtures of readily available materials such as hydroxypropylmethyl cellulose, hydroxypropyl cellulose, hydroxyethyl cellulose, and carboxymethyl cellulose. Other materials may be included as are understood in the art. The viscosity of the cellulosic ethers may vary over a broad range, i.e., from 10 cp to 100,000 cp, as measured for a 2% aqueous solution of the material.

By way of example, hydroxypropyl methylcellulose having viscosities of 50 and 4000 centipoise for 2% aqueous solutions at 20° C. are known and commerciallly available as Methocel E-50 and E-4M, respectively (Dow Chemical Company registered trademarks). Hydroxypropyl cellulose as used in accordance with the invention is known and commercially available as Klucel (a Hercules Inc. registered trademark).

Any known bleaching agent may be employed. It is preferred, however, to use the inexpensive inorganic chlorine-containing bleaches known in the art, e.g., the alkali and alkaline earth metal salts of hypochlorous acid. Sodium hypochlorite is a preferred bleach. Broadly, the composition of the invention contains from 0.10% to 1.0% by weight available chlorine.

The organic acids used in the compositions of the invention include the lower molecular weight acids, formic, acetic, citric, fumaric, and glycolic acids. Glycolic acid is a preferred species. Broadly, the amount of organic acid in the composition is from 0.05 to 25.0% by weight. Preferably, the amount of acid in the composition is from 0.5% to 10.0%.

It is advantageous to prepare the compositions which are ultimately used to blotch-bleach the fabrics or garments starting from a thickener/organic acid mixture and adding the bleach thereto. Advantageous thickener/organic acids according to the invention include (a) a major portion of a cellulosic ether selected from the group consisting of hydroxypropylmethyl cellulose, hydroxypropyl cellulose, hydroxyethyl cellulose, and carboxymethyl cellulose, and (b) a minor amount of inorganic acid selected from the group consisting of lower molecular weight acids, including formic, acetic, citric, fumaric, and glycolic acids. To this mixture is then added an aqueous solution of, e.g., sodium hypochlorite (12.0% available chlorine) until the composition contains available chlorine in the range of 0.1 to 1.0% by weight.

The method of the invention comprises the step of introducing compositions of the invention into a washing machine together with the fabrics or garments to be blotch bleached. The thickener/organic acid can be added first together with the garments followed by introduction of the bleach. Alternatively, and preferably, the three-part compositions of the invention comprising thickener, organic acid, and bleach, are introduced into the washing machine together. It is important, in order to obtain the blotchy-bleach effect of the invention to create an inhomogeneous mixture of the bleach and the balance of the composition. Accordingly, the bleach is stirred partially, perhaps 1 to 3 times, in order to create a suspended but inhomogeneous mixture of the bleach in the other materials.

Broadly, from 0.5 to 4.0 pounds of the three-part composition are used per pound of garments or fabric, and desirably from 1.5 to 2.5 pounds of composition is used per pound of garments or fabric.

The composition and the fabrics, which are desized prior to their introduction into the washing machine, are then tumbled for, broadly, from 10 seconds to 60 minutes, and preferably from 30 seconds to 5 minutes.

After the blotch-bleach step has been completed, the garments or fabrics in the washing machine can be subjected to antichlor neutralization action, rinsing, softening, and drying, by steps well known in the art.

The invention is further described in the following example.

EXAMPLE 1

A thickener/organic acid composition was formed containing 99.1% of hydroxyethyl cellulose (having a viscosity of 25,000 cp when measured in a 2% solution) and 0.9% glycolic acid. To this two-component mixture was added sodium hypochlorite (12.0% available chlorine). 0.37 ounces of the sodium hypochlorite was added per pound of the thickener/organic acid mixture so as to provide a composition containing 0.3% available chlorine. The mixture was stirred twice and poured into another container. The stirring step immediately preceded the use of the composition in the garment bleaching step.

Desized garments were introduced into a conventional washing machine and the composition prepared as above was pumped into the machine while the garments were tumbling. The pumping time was approximately 15 seconds. The garments were then tumbled for 30 seconds.

They were thereafter subjected to antichlor action by introducing sodium metabisulfite into the washing machine, rinsed in clean water, and softened and dried as known in the art.

What is claimed is:

1. A method for obtaining a blotchy bleached effect on denim garments or fabric comprising the steps of:
   (a) forming a composition suitable for processing said garments or fabrics by partially mixing from about 0.1 to about 1.0 weight percent sodium hypochlorite as a bleaching agent with a thickened carrier medium comprising
      (i) from about 0.05 to about 25 weight percent hydroxyethyl cellulose as a thickener which hydroxyethyl cellulose has a viscosity of about 25,000 cp when measured in a 2% solution, and
      (ii) from about 0.5 to about 10 weight percent glycolic acid,
   (b) introducing the composition into a washing machine containing the garments or fabrics and processing the garments or fabrics by tumbling the garments or fabrics together with the composition for about 10 seconds to 60 minutes; and
   (c) subjecting the processed garments or fabrics to antichlor action by introducing sodium metabisulfite into the washing machine, and then rinsing, softening and drying the fabrics or garments.

2. A method for obtaining a blotchy bleached effect on denim garments or fabrics comprising the steps of:
   (a) forming a composition suitable for processing said garments or fabrics by partially mixing about 0.37 ounces of sodium hypochlorite having 12.0% available chlorine, as a bleaching agent, per pound of a thickened carrier medium, which medium comprises
      (i) about 99.1 of hydroxyethyl cellulose as a thickener which hydroxyethyl cellulose has a viscosity of about 25,000 cp when measured in a 2% solution, and
      (ii) about 0.9% glycolic acid,
   (b) pumping the composition into a washing machine containing the garments or fabrics and processing the garments or fabrics by tumbling the garments or fabrics together with the composition for about 30 seconds; and
   (c) subjecting the processed garments or fabrics to antichlor action by introducing sodium metabisulfite into the washing machine, rinsing the garments or fabrics with water, and then softening and drying the fabrics or garments.

* * * * *